US005816784A

United States Patent [19]

Postuchow et al.

[11] Patent Number: 5,816,784

[45] Date of Patent: Oct. 6, 1998

[54] ELECTROMAGNETIC ACTUATOR MECHANISM FOR CENTRIFUGAL PUMP

[75] Inventors: Jack R. Postuchow, Aurora; Randal P. Griffith, Wheat Ridge, both of Colo.

[73] Assignee: A. R. Wilfley & Sons, Inc., Denver, Colo.

[21] Appl. No.: 644,042

[22] Filed: May 9, 1996

Related U.S. Application Data

[63] Continuation-in-part of Ser. No. 369,702, Jan. 6, 1995, Pat. No. 5,580,215.

[51] Int. Cl.[6] ..... F04B 35/04

[52] U.S. Cl. ..... 417/423.11; 417/12; 415/113; 415/171.1; 415/231; 277/28; 277/81 R; 277/901

[58] Field of Search ..... 417/12, 423.1, 417/423.11; 415/13, 113, 230, 231, 171.1; 277/28, 81 R, 82, 80, 901

[56] References Cited

U.S. PATENT DOCUMENTS 4,447,063 5/1984 Kotzur et al. ..... 277/28
4,722,663 2/1988 Swearingen ..... 277/28
4,915,579 4/1990 Whittier, et al. ..... 415/171.1
5,261,786 11/1993 Sidelko ..... 415/171.1
5,667,356 9/1997 Whittier et al. ..... 415/113

*Primary Examiner*—Charles G. Freay
*Attorney, Agent, or Firm*—John E. Reilly

[57] ABSTRACT

An electromagnetic actuating mechanism is provided for a centrifugal pump in which a solenoid ring includes a radially inwardly projecting annular seal movable between open and closed positions with respect to a rotary seal which is mounted for rotation with the drive shaft between the expeller and reservoir region of the pump housing. Spring members are engageable with the ring to normally retain the annular seal in the closed position when the pump is not in operation, and a magnetic drive member is selectively energized to initiate movement of the ring in a direction overcoming the biasing elements to shift the ring to an open position when pump operation is initiated. An energizing control circuit is associated with the pump motor to regulate energizing and deenergizing of the drive member.

20 Claims, 3 Drawing Sheets

ELECTROMAGNETIC ACTUATOR MECHANISM FOR CENTRIFUGAL PUMP

CROSS-REFERENCE TO RELATED APPLICATIONS

This application is a continuation-in-part of Ser. No. 369,702, filed 6 Jan. 1995 for CENTRIFUGAL PUMP WITH ELECTROMAGNETIC ACTUATOR MECHANISM, by John E. Sidelko et al and assigned to the assignee of the present invention now U.S. Pat. No. 5,580, 215.

BACKGROUND AND FIELD OF INVENTION

This invention relates to pumping apparatus; and more particularly relates to a novel and improved electromagnetic actuating mechanism for establishing a mechanical seal when the pumping apparatus is at rest whereby to effectively seal against leakage behind the expeller region of the pump.

A. R. Wilfley & Sons, Inc., the assignee of this invention, has made substantial advancements in the development of centrifugal pumps of the type described. Of the more recent advancements, U.S. Pat. No. 4,915,579 to Whittier et al is characterized in particular by completely isolating the actuating mechanism of the valve assembly from the liquid in the reservoir and in which the actuating mechanism comprises centrifugal force-responsive pivot members which will overcome the normal biasing of the spring-loaded valve assembly to open the valve assembly and make possible the discharge of liquid from the reservoir region of the pump during start-up periods, and the actuating mechanism is sealed at all times from the working fluid so as not to be exposed to contaminants or foreign particles in the fluid. Further, in Whittier et al, there is disclosed a novel and improved expeller ring and baffle plate arrangement in the path of fluid flow between the expeller ring and seal housing to discourage the flow of fluid from the pump casing into the seal housing. In U.S. Pat. No. 5,261,786 to Sidelko, washer-like spring elements are provided as a part of the spring-loaded valve assembly in which the regressive characteristics of the spring elements are such that they will undergo a large degree of deflection for a relatively small change in force at a speed just below the operating speed of the pump so that the valve will not begin to move away from the closed position until the pump is substantially up to operating speed; and as the pump speed is reduced below its operating speed, the spring elements will rapidly expand so as to cause almost instantaneous closure below the operating speed of the pump to avoid leakage of fluid back into the reservoir housing. As in the '579 to Whittier et al, the '786 patent to Sidelko utilizes centrifugal force-responsive, weighted pivot members isolated within a seal housing to overcome the bias or urging of the spring-loaded valve assembly.

In certain pump applications, such as, those handling low surface tension fluids, there is a need for a valve assembly which can achieve positive opening and closing of the reservoir behind the expeller region during start-up and shut-down periods with a closely controlled force so as to enable use of highly sensitive seals and ease the hydraulic load on the bearings behind the expeller region; and further to insure complete removal of any fluid in the region adjacent to the valve assembly seals during the start-up period. It is therefore proposed in accordance with the present invention to provide a novel and improved actuating mechanism for the valve assembly which can be closely controlled independently of centrifugal force to regulate opening and closing of the valve assembly and which actuating mechanism is compact and can be completely isolated from the working fluids and any contaminants in the fluid. Furthermore, it is desirable to simplify the actuating mechanism while improving the speed and force of opening and closing of the valve element over a greater distance than heretofore possible and closely controlling the timing of the opening and closing movement of the valve element at the beginning and end of pump operation to achieve optimum sealing capability.

SUMMARY OF THE INVENTION

It is therefore an object of the present invention to provide for a novel and improved actuating mechanism for pumping apparatus.

Another object of the present invention is to provide for a novel and improved pump sealing apparatus which is specifically adaptable for use with working liquids having low surface tension, is capable of easing the hydraulic load on the bearings in the shaft mounting region of the pump and achieves improved circulation of fluid via the expeller region of the pump.

A further object of the present invention is to provide for a novel and improved pump sealing apparatus which is specifically adaptable for use with working liquids having low surface tension, reduces critical tolerances between parts of the actuating mechanism, and increasing the axial displacement while resisting rotary displacement of the movable seal with respect to the stationary seal.

An additional object of the present invention is to provide for a novel and improved pump sealing apparatus in which an actuating mechanism is completely isolated from the liquid in the reservoir and which mechanism is of the electromagnetic type which can be closely controlled independently of the operating speed of the pump to effect positive opening and closing of the valve assembly for the reservoir region of the pump.

In accordance with the present invention, an electromagnetic actuating mechanism has been devised for pumping apparatus wherein a magnetizable ring in the pump housing is journaled with respect to a rotary drive shaft, the ring having an annular seal movable between open and closed positions with respect to a rotary seal to prevent passage of working fluid between the expeller and reservoir regions of the pump when the annular seal is in the closed position. Biasing means are engageable with the ring to normally retain the annular seal in a closed position against the rotary seal when the pump is not in operation, and actuating means including a magnetic drive member is selectively energizable to overcome the biasing means to move the annular seal to an open position.

Preferably, the magnetic drive member is in the form of annular magnetic coils which are selectively energized by a timer circuit operably connected to the pump motor, the timer circuit including relays which are selectively energized at predetermined time intervals after the motor is turned on to shift the annular seal to an open position during pump operation, and a current-sensing circuit senses when the motor is turned off to immediately deenergize the magnetic coils to permit the seal to return to a closed position to prevent fluid leakage from the expeller region into the reservoir region of the pump when the pump is not in operation. The drive member is preferably in the form of a solenoid ring and the biasing means in the form of return springs extending through bores in the ring to greatly simplify the structure of the actuating mechanism, enable improved mounting of the annular seal and increase the stroke of the seal between open and closed positions.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
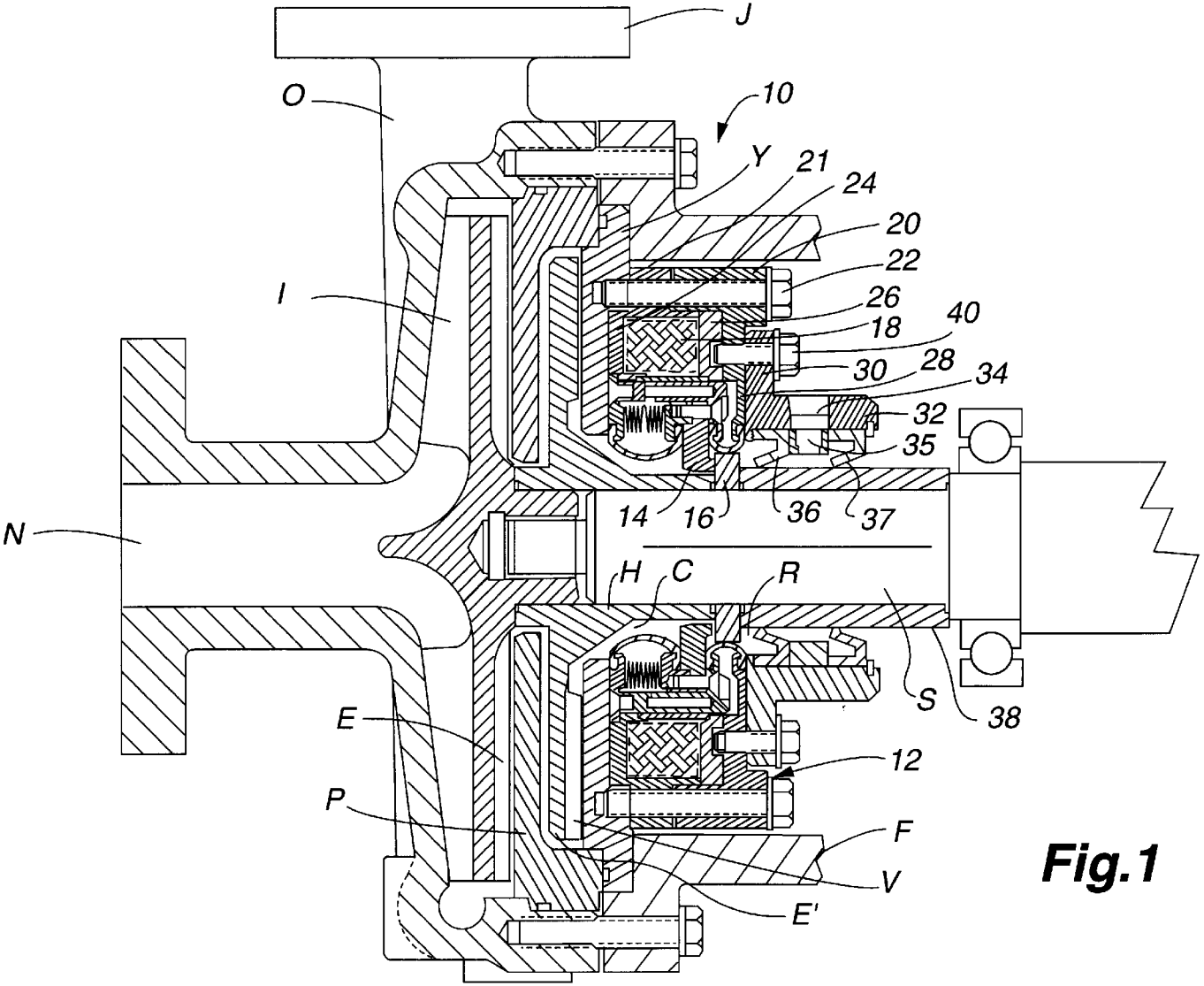
FIG. 1 is a somewhat fragmentary longitudinal sectional view with a portion of the pump bearing frame removed of the preferred form of invention.
Figure 2:
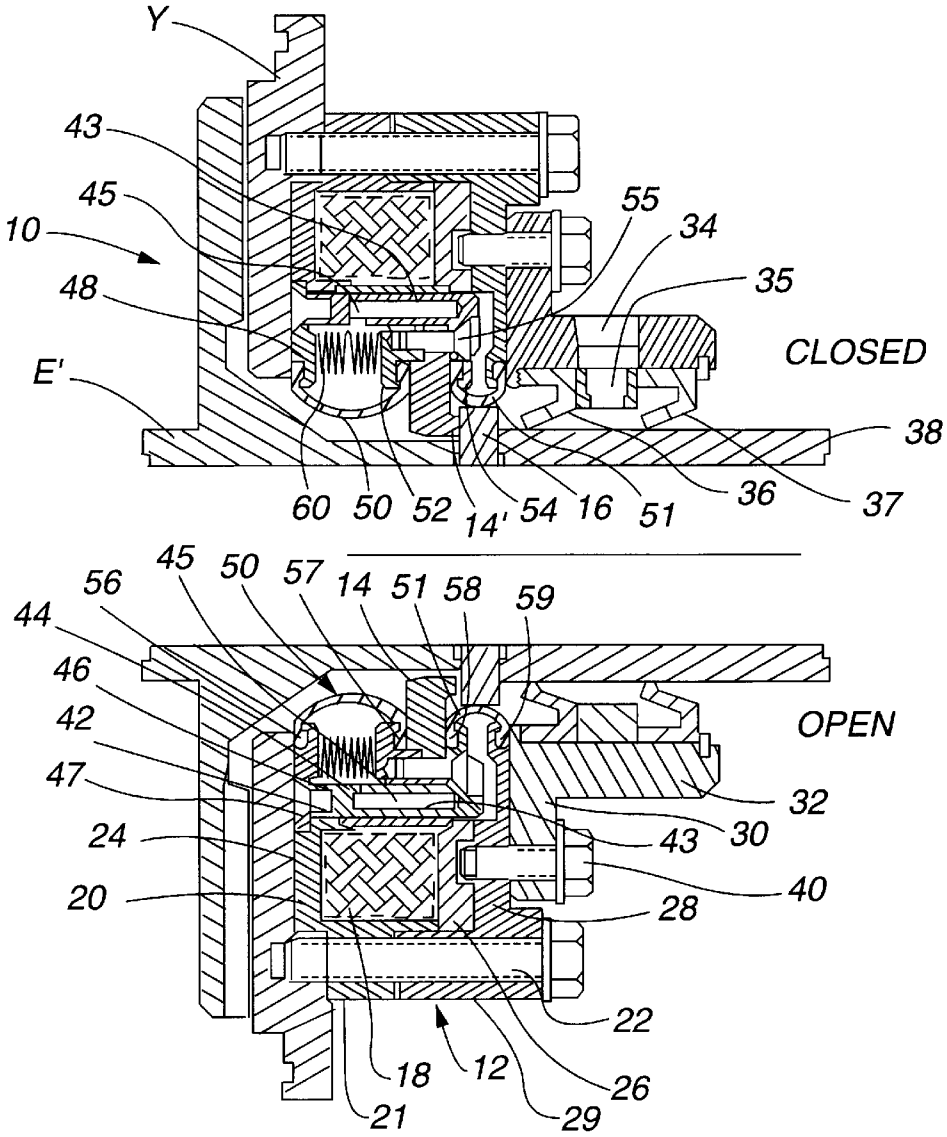
FIG. 2 is an enlarged longitudinal sectional view of the actuating mechanism of the preferred form and illustrating the mechanism in the open and closed positions.

Referring to the drawings in more detail, a preferred form of pumping apparatus 10 is illustrated in FIGS. 1 and 2, the upper half of the views illustrating the apparatus in a closed position and the lower half illustrating the apparatus in an open position; and in FIG. 2 only the secondary expeller region and actuating mechanism are illustrated. Broadly, the apparatus 10 comprises an impeller I mounted for rotation on a drive shaft S. The case J includes an inlet N at its forward end for introduction of a liquid which under the rotation of the impeller I is driven through the outlet O of the case J. A primary expeller E and secondary expeller E' are separated by a case plate P, the secondary expeller E' having rearwardly directed radially extending vanes V. The expeller E' is interposed between the case plate P and an expeller plate Y which is attached to the case J to establish a continuous fluid channel C from the secondary expeller E into a reservoir region R.

Figure 3:
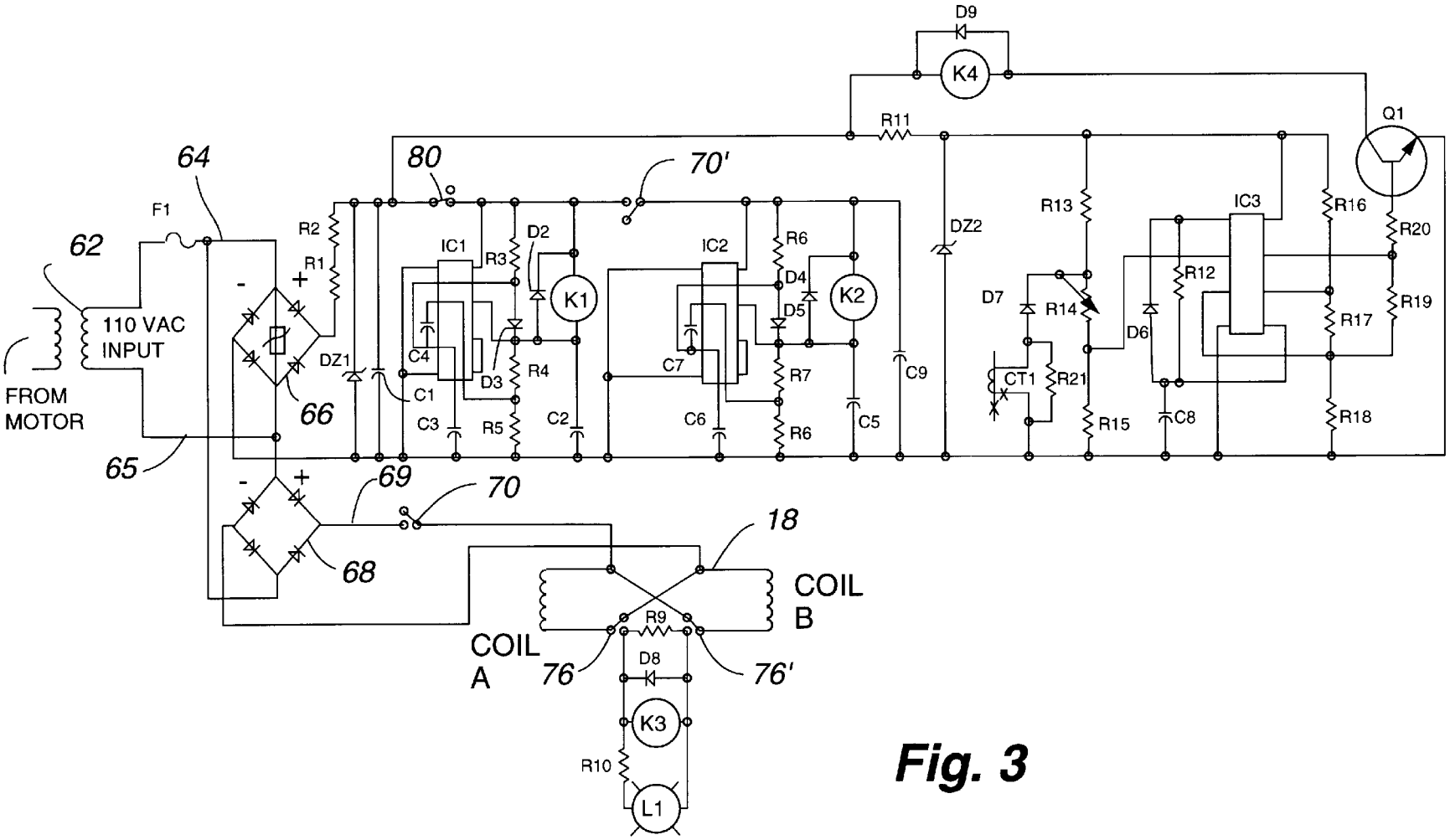
FIG. 3 is a block diagram of the energizing control circuit for the actuating mechanism of the present invention.

A preferred form of electromagnetic actuating mechanism 12 is mounted behind the expeller region to regulate opening and closing of a circumferentially extending facial seal 14 with respect to a circumferentially extending rotary seal 16. The mechanism 12 is housed within a pump bearing frame F, a portion of which is shown mounted or affixed to the case J. The actuating mechanism 12 is comprised of an annular magnetic drive member 18 having coils A and B, as shown in FIG. 3, enclosed within a metallic housing 20 having an outer circumferentially extending rib 21 affixed to the expeller plate Y by circumferentially spaced fasteners 22. A front end wall or face 24 of the housing 20 is disposed in flush abutting relationship to a rearward end surface of the expeller plate Y and a rear, radially extending end wall or face 26 of the housing abuts a radial support wall 28, the latter having a series of bosses 29 at circumferentially spaced intervals for insertion of the fasteners 22. A rearward extension wall 30 includes an axially extending housing portion 32 for a grease seal 34 in which a center port or grease cup 35 is interposed between axially spaced lip seals 36 and 37 which bear against a sleeve portion 38 forming a rearward extension of hub H of the secondary expeller E' and of the rotary seal 16. The support wall 28 is securely affixed between the end wall 26 and extension wall 30 by a series of circumferentially spaced fastener screws 40.

A radially inner wall 42 of the housing 20 is in the form of a circumferentially extending low-friction band which is securely affixed between radially inner notched portions on opposite end walls 24 and 26 of the housing 20 and surrounds a series of circumferentially spaced bores 43 in a solenoid ring or housing 44, each bore 43 receiving a return spring 45. The outer wall surface of the ring 44 is in surface engagement with the low-friction wall surface 42 of the housing 20, and each return spring has one end anchored to an annular block 46 which in turn is affixed to an annular end plate 48 by a series of fasteners 47 and located radially inwardly of the end wall 24.

The seal 14 is interposed between a pair of diaphragms or boots 50 and 51 for inward radial extension from the solenoid ring 44 whereby to undergo axial sliding movement in response to energization of the solenoid ring 44 by the drive member 18 into and away from engagement with the seal 16. Preferably, the outer peripheral end of the seal 14 is sandwiched between an end plate 52 for the boot 50 and end plate 54 for the boot 51 and securely affixed thereto by circumferentially spaced fastener screws 55 to unite the assembly to the solenoid ring 44, the end plate 54 being integral with the end of the ring 44. The boot 50 is preferably in the form of a flexible annular member composed of rubber or rubber-like material and of generally convex cross-sectional configuration terminating on opposite sides in enlarged flanges or beads 56 and 57. The bead 56 is anchored within a recessed portion of the end plate 48 and securely held against the inner radial end of the expeller plate Y; and the bead 57 at the opposite side of the boot 50 is anchored within a recessed portion in the end plate 52 and held securely against one side of the seal 14. The boot 51 is of slightly lesser width than the boot 50 but of a corresponding construction with a bead 58 anchored within a recessed portion of the end plate 54 and bead 59 anchored within a recessed portion at the inner radial end of the support wall 28 and held securely against a radial surface of the axial portion 32. An accordion-shaped annular bellows 60 is mounted under compression between the end plates 48 and 52 within the diaphragm 50 to urge the end plate 52 in a direction causing the seal 14 to be retained in the closed position, as shown in the upper half of FIG. 1, against the rotary seal 16. In this relation, preferably the seal 14 is of generally rectangular cross-section with a radially inner offset portion 14' having a radial end surface movable into flush engagement with a radial wall of the rotary seal 16.

FIG. 3 illustrates an energizing control circuit for the electromagnetic actuating mechanism 12 and specifically the drive member 18 made up of the pair of coils A and B. In accordance with conventional practice, the pump is operated by a three-phase motor, not shown, and a transformer 62 steps down the voltage from the motor, for example, from 440 volts to 110 volts via lines 64 and 65 into a bridge rectifier 66. One side of the bridge rectifier 66 is connected to a second bridge rectifier 68 which is connected via line 69 having contacts 70 of relay K1 into opposite sides of the coils A and B as illustrated. A timer circuit into the relay K1 from the bridge rectifier 66 includes Zener diode DZ1, capacitors C1, C2, C3, C4, voltage comparator 72 and various resistors R1 to R5 as shown along with diodes D2 and D3. Zener diode DZ1 will limit the voltage from the bridge rectifier 66 to 24 volts whereas the voltage through the bridge rectifier 68 is not so limited and will be that of the rectifier output 68. Charging of the capacitor C3 will control actuation of the relay contact 70 to energize the drive member 18 as well as to actuate contact 70' to the second timer relay K2 which is energized a predetermined time period after the relay contact 70' is actuated as controlled by the voltage comparator 74, capacitors C5, C6, C7 and C9, diodes D4 and D5 and resistors R6–R8. Initially, when the relay K1 is energized, the relay contact 70 of the relay K1 closes the circuit for the coils A and B so that current flows through the coils A and B in parallel so as to be at an increased strength in order to activate the solenoid ring 44. However, when the relay K2 is energized a predetermined time period after closing of relay contacts 70' of K1, the K2 relay contacts 76 and 76' are actuated to connect the coils A and B in series and across the resistor R9 to substantially reduce the amount of current flowing into the coils, since relatively little electromagnetic force is required to keep the solenoids energized.

A current sensing circuit deenergizes the relays K1 and K2 when the motor is turned off in order to deenergize the drive member 18 immediately notwithstanding any residual current flow into the bridge rectifiers 66 and 68 as the motor winds down. For this purpose, the diode DZ2 limits the voltage to 12 volts across a current transformer CT1, operational amplifier IC3 and transistor Q1. The current sensing circuit also includes a capacitor C8, diodes D6, D7 and D9, and resistors R12 to R21. When the current transformer CT1 senses that the motor is turned off and there is no longer any current passing into the motor, the relay K4 is energized to effectively deactivate its contact 80 and deenergize the relays K1 and K2. The relay K3 across the coils A and B allows for monitoring of the circuit by the customer, and light L1 is activated by relay K2 to indicate that the pump is in a running mode.

Preferably, in the control circuit as described, there is approximately a 3 second time delay for energizing relay K1 and another 1.5 second time delay to energize relay K2. Again, when relay K1 is energized, the K1 relay contact 70 is actuated so that current flows in parallel through the coils to apply sufficient electromagnetic force to drive the solenoid ring 44 in a direction to open the valve member or seal 14, as shown in the lower half of FIG. 2. The current flow can be substantially reduced once the solenoid ring 44 has been shifted in order to minimize heat build-up in the coils A and B over long term operation of the pump by connecting the coils A and B in series when the relay K2 is energized. When the motor is turned off, the current transformer CT1 will instantaneously sense the absence of current to the motor and energize the relay K4 thereby deenergizing the relays K1 and K2 in order to cut off current flow to the coils A and B. As a result, the return springs 45 will cause the seal 14 to return to its closed position against the seal 16 within fractions of a second after the motor is turned off thereby preventing leakage of the working fluid through the fluid channel between the expeller region and the seal 36 at the entrance to the reservoir or grease seal. Any limited amount of fluid that does seep past the lip seal 36 is effectively prevented from advancing past the grease seal 34; and any fluid that may build up in the fluid channel C behind the seal 16 will be returned into the expeller region when the seal 14 is opened at the start of pump operation.

A particular advantage of utilizing the solenoid ring 44 is that it does not require close tolerances and can effectively double the travel or stroke of the ring 44 compared to that of a clapper of the type shown in my copending U.S. application for patent Ser. No. 369,702 entitled CENTRIFUGAL PUMP WITH ELECTROMAGNETIC ACTUATOR MECHANISM, now U.S. Pat. No. 5,580,215; and the inner wall 42 of the housing 20 defines a low-friction surface for ease of movement of the solenoid ring 44. In addition, anchoring of the seal 14 as described resists torsion or rotary displacement of the seal 14 with respect to the rotary seal 16. Although a continuous solenoid ring 44 is illustrated, it will be apparent that a series of solenoids may be arranged in circumferentially spaced relation to one another and simultaneously activated by the drive member 18 to control opening movement of the seal 14.

It is therefore to be understood that while a preferred form of invention is herein set forth and described, various modifications and changes may be made in the invention including composition of materials and construction of parts without departing from the spirit and scope of the invention as defined by the appended claims and reasonable equivalents thereof.

We claim:

1. An electromagnetic actuating mechanism for pumping apparatus wherein a pump housing is journaled on a rotary drive shaft, an impeller and expeller are keyed for rotation with said drive shaft, and a rotary seal is rotatable with said drive shaft with said expeller disposed between said impeller and said rotary seal, said mechanism comprising:

a magnetizable ring in said housing and journaled with respect to said rotary drive shaft, said ring including an annular seal movable between open and closed positions with respect to said rotary seal whereby to prevent passage of working fluid past said rotary seal when said annular seal is in the closed position;

biasing means engageable with said ring to normally retain said annular seal in the closed position against said rotary seal when said apparatus is not in operation; and actuating means for overcoming said biasing means to move said annular seal to an open position including a magnetic drive member disposed in concentric relation to said ring, and energizing means electrically connected to said magnetic drive member to selectively energize said drive member whereby to initiate movement of said ring in a direction overcoming said biasing means to shift said annular seal to the open position.

2. The mechanism according to claim 1 wherein said ring includes circumferentially spaced bores, and said biasing means includes return springs mounted in said bores.

3. The mechanism according to claim 2 wherein said bores are arranged at equally spaced intervals, and said magnetic drive member is disposed in outer concentric relation to said ring.

4. The mechanism according to claim 3 wherein said drive member includes a pair of annular coils, and wherein said energizing means includes a motor and a timing circuit for energizing said energizing means a predetermined time interval after start-up of said motor.

5. The mechanism according to claim 2 wherein said drive member includes a housing having a low friction surface contacting an outer surface of said ring.

6. The mechanism according to claim 5 wherein said drive member includes current-sensing means for deenergizing a timing circuit when said motor is turned off.

7. The mechanism according to claim 6 wherein a step-down transformer electrically interconnects said motor to said timing circuit.

8. The mechanism according to claim 4 wherein said timing circuit includes means for converting said coils between a parallel and series connection.

9. The mechanism according to claim 1 wherein said drive member includes a timing circuit energizable a predetermined time interval after said motor is turned on, and current-sensing means for deenergizing said drive member directly in response to turning off said motor.

10. The mechanism according to claim 9 wherein said drive member includes a pair of coils and said timing circuit includes a second relay energizable a predetermined time interval after a first relay is energized to convert said coils from parallel to series connection.

11. The mechanism according to claim 10 wherein said timing circuit includes a Zener diode interposed between a bridge rectifier and said first relay.

12. The mechanism according to claim 11 wherein a second Zener diode is interposed between said second relay and said current sensing means.

13. An electromagnetic actuating mechanism for a centrifugal pump wherein a pump housing is journaled on a rotary drive shaft, an impeller and expeller are keyed for rotation with said drive shaft, and a rotary seal is rotatable with said drive shaft between said expeller and a reservoir within said housing, said mechanism comprising:

an annular magnetizable member in said housing and journaled with respect to said rotary drive shaft, an annular seal movable with said magnetizable member between open and closed positions with respect to said rotary seal whereby to prevent passage of working fluid between said expeller and reservoir when said annular seal is in the closed position;

biasing means engageable with said magnetizable member to normally retain said annular seal in the closed position against said rotary seal when said pump is not in operation; and actuating means for overcoming said biasing means to move said annular seal to an open position including an electromagnetic drive member disposed in concentric relation to said magnetizable member, and energizing means electrically connected to said magnetic drive member to selectively energize said drive member whereby to initiate movement of said magnetizable member in a direction overcoming said biasing means to shift said annular seal to the open position.

14. The mechanism according to claim 13 wherein said magnetizable member is in the form of a ring having circumferentially spaced bores, said biasing means includes return springs mounted in said bores and said drive member is disposed in outer concentric relation to said ring.

15. The mechanism according to claim 13 wherein said drive member includes a pair of annular coils and a housing having a low friction surface contacting an outer surface of said magnetizable member, and wherein said energizing means includes a motor and a timing circuit for energizing said energizing means a predetermined time interval after start-up of said motor.

16. In pump sealing apparatus wherein a pump includes a casing reservoir in surrounding relation to a drive shaft, and an impeller on said drive shaft for discharging liquid introduced from an inlet through an outlet in the casing, a motor for operating said pump, at least one expeller between said impeller and said reservoir to resist liquid flow past said expellers when said pump is in operation, and wherein an annular seal is movable between open and closed positions in relation to a sealing surface portion with electromagnetic drive means engageable with said annular seal to advance said annular seal to the open position, the improvement comprising:

energizing means including a timing circuit for activating said energizing means a predetermined time interval after start-up of said motor, said timing circuit including current-sensing means for deenergizing said timing circuit directly in response to turning off said motor.

17. In pump sealing apparatus according to claim 16 wherein said timing circuit includes at least one relay energizable a predetermined time interval after said motor is turned on, and said current-sensing means being operative to deenergize said relay directly in response to turning off said motor.

18. In pump sealing apparatus according to claim 17 wherein said timing circuit includes a second relay energizable a predetermined time interval after said one relay is energized, and a Zener diode interposed between a bridge rectifier and said one relay.

19. In pump sealing apparatus according to claim 18 wherein a second Zener diode is interposed between said second relay and said current-sensing means.

20. In pump sealing apparatus according to claim 16 wherein said drive means includes a pair of annular coils connected in parallel, said timing circuit include one relay energizable a predetermined time interval after said motor is turned on and a second relay energizable a predetermined time interval after said one relay is energized to convert said coils from parallel to series connection, and current-sensing means for deenergizing said one relay directly in response to turning off said motor.

* * * * *